US008955776B2

(12) United States Patent
Adam et al.

(10) Patent No.: US 8,955,776 B2
(45) Date of Patent: Feb. 17, 2015

(54) METHOD OF CONSTRUCTING A STATIONARY COAL NOZZLE

(75) Inventors: Daniel J. Adam, East Canaan, CT (US); Paul M. Bovat, Jr., Enfield, CT (US); Thomas J. Campanelli, Berlin, CT (US); Kevin J. Grzebien, Southwick, MA (US); James P. Sutton, South Windsor, CT (US)

(73) Assignee: ALSTOM Technology Ltd, Baden (CH)

( * ) Notice: Subject to any disclaimer, the term of this patent is extended or adjusted under 35 U.S.C. 154(b) by 1216 days.

(21) Appl. No.: 12/713,602

(22) Filed: Feb. 26, 2010

(65) Prior Publication Data

US 2011/0210191 A1 Sep. 1, 2011

(51) Int. Cl.
*B05B 1/00* (2006.01)
*F23D 1/00* (2006.01)

(52) U.S. Cl.
CPC ... *B05B 1/00* (2013.01); *F23D 1/00* (2013.01); *F23D 2201/10* (2013.01); *F23D 2201/20* (2013.01); *F23D 2201/30* (2013.01)
USPC ..... 239/591; 239/589; 239/592; 239/594; 239/597; 239/600; 239/654; 110/261; 110/263; 48/210

(58) Field of Classification Search
USPC ..... 239/589, 591, 592–594, 597, 598, 600, 239/650, 654; 110/260, 261, 263, 267; 48/210
See application file for complete search history.

(56) References Cited

U.S. PATENT DOCUMENTS

| | | | | |
|---|---|---|---|---|
| 4,373,900 | A | 2/1983 | Eckelmann | |
| 4,611,543 | A | 9/1986 | Collette | |
| 4,634,054 | A | 1/1987 | Grusha | |
| 5,215,259 | A * | 6/1993 | Wark | 110/263 |
| 5,435,492 | A * | 7/1995 | Tenerowicz | 239/600 |
| 6,145,764 | A * | 11/2000 | Gonzalez et al. | 110/261 |
| 6,474,250 | B1 | 11/2002 | Penterson et al. | |
| 7,216,594 | B2 * | 5/2007 | Nowak et al. | 110/261 |
| 7,748,650 | B1 * | 7/2010 | Sloan | 239/593 |

* cited by examiner

*Primary Examiner* — Steven J Ganey
(74) *Attorney, Agent, or Firm* — Robert D. Crawford

(57) ABSTRACT

Disclosed herein is an apparatus and method of constructing a stationary wear-resistant stationary nozzle 200 and/or nozzle liner 230 for solid fueled furnaces. A transition section 210 is constructed from several flat pieces 211-218 several that may have identical starting shapes. This reduces manufacturing complexity and costs. All pieces 211-218 have a high-wear weld overlay on their inner surface 316, 416. Corner pieces 215-218 are folded into a corner shape at an outlet edge 412 and rolled into a curved shape at an inlet edge 411. Horizontal 211, 212 and vertical pieces 213, 214 are only rolled at an inlet edge 311. The pieces have seam tab 240 along longitudinal edges that are welded together to construct a transition section 210. The transition section 210 may be used as a liner to reduce wear in an existing stationary nozzle or may be constructed to be connected to an inlet piece 220 to form a strong, wear-resistant coal nozzle 200.

19 Claims, 8 Drawing Sheets

METHOD OF CONSTRUCTING A STATIONARY COAL NOZZLE

BACKGROUND

1. Field of the Invention

This disclosure relates to high-wear nozzles for directing the flow of solid particles entrained in a fluid stream.

2. Discussion of Related Prior Art

A solid-fueled firing system burns powdered solid fuel; typically coal, blown into a furnace in a stream of air. This furnace is typically a boiler that creates steam for various uses, such as creating electricity. FIG. 1 shows a stationary solid fuel nozzle assembly 100 and a coal nozzle tip 130 used to inject the pulverized solid fuel into the boiler. The pulverized solid fuel is provided by coal piping (not shown) that attaches to a round flange 140. The function of the stationary nozzle 100 is to direct a coal air mixture into the nozzle tip 130 and then into a combustion chamber of a furnace.

The coal piping and the round flange 140 have a round cross-sectional shape. The nozzle tip 130 has a rectangular or square cross-sectional shape. Therefore, the cross-sectional geometry of the nozzle 100 must change from round at its inlet 103, to a square flange to mate with the coal nozzle tip 130.

A transition section 110 between the inlet 103 and the nozzle tip 130 must accelerate the coal mixture as it passes through the nozzle 100 from a transport velocity at its round inlet 103 to a predetermined higher velocity required for optimum performance at the coal nozzle tip 130.

Powdered coal itself is not very abrasive; however, the impurities in the coal, such as ash and silica can be very abrasive. The impurities can comprise typically 10-20% of the coal composition. Therefore, blowing the pulverized solid fuel through the nozzle 100 can have the same effect as sandblasting. The high velocity abrasive coal-air mixture therefore causes rapid erosion of the coal nozzle 100 and nozzle tip 130.

Whenever an electricity producing plant is not in operation, the power plant operator is required to buy electricity from alternative sources for its customers. This can become very costly.

The coal nozzle 100 is located within the boiler windbox, so removal, repair and replacement is time-consuming and expensive. Removal requires that the boiler be shut down and cooled. The access panels on the windbox are removed and the coal piping disconnected. All this takes time so coal nozzles 100 can only be replaced during a relatively long shutdown. Due to the expense and difficulty of replacing these, a long service life is extremely important. Previous attempts to maximize service life of the stationary coal nozzle consisted of using thick cast iron structures or lining the stationary coal nozzle with ceramic tiles. There were shortcomings with these prior art methods of reducing wear in the nozzles 100.

Even with the increased thickness cast iron nozzles, they did not last much longer. The abrasion resistance of cast iron is much lower than typical wear protecting materials. The cast iron coal nozzles rarely last more than 3-6 years, depending on the coal type burned. This limited the length of time a boiler could be used without an extended maintenance shutdown. If the cast iron coal nozzle 100 is damaged, repair is also difficult because cast iron is difficult to weld. Also, cast iron nozzles are very heavy and difficult to transport and install.

Ceramic is more wear resistant than cast iron. Therefore, lining the nozzles with ceramic tiles increased the usable life of the nozzles. However, these tiles are difficult to attach to the nozzle inner surface. They are typically plug welded, and tend to detach easily. Due to the odd geometry of a transition from a round cross-sectional shape to a square cross-sectional shape, it is difficult to create tiles that fit tightly together.

It is important to understand that the ceramic tiles are typically arranged in a roman arch design. Once one tiles is lost, the remaining tiles are no longer held in place and also are lost.

Coefficients of expansion are vastly different from ceramic to steel. This means that large temperature fluctuations are likely to cause separation between ceramic tiles and the nozzle surface. This causes the tiles to fall off leaving the nozzle base material unprotected.

An additional shortcoming is that the ceramic tile system is relatively fragile. If lifted by fork trucks or similar lifting equipment there is a possibility that they will flex and crack tiles. They are frequently damaged in transport to the site or during installation. Once damaged, the tile cannot be replaced in the field.

Ceramic tiles can become dislodged and fall off when the coal nozzle buckles due to increase loads. Tiles also become dislodged when customers use large vibrations or percussions to dislodge slag from the equipment within the boiler.

Coal particles sometimes build up in the nozzles. Combustion sometimes propagates down the nozzle creating what are known as furnace "puffs". These create vibrations that also may dislodge or damage ceramic tiles.

Furthermore, if damage occurs, it may be internal and not visible. This creates the potential that cracked tiles may be unknowingly installed in the nozzles 100. There is a possibility that the nozzles may wear through and cause a windbox fire. This can lead to major damage and repair costs to the facilities and a possibility safety hazard.

Currently, there is a need for an economical, easily constructed, wear-resistant nozzle for directing a stream of abrasive particles entrained in a fluid.

SUMMARY

The invention may be embodied as a high-wear solid fuel nozzle transition section having a alternating corner pieces and wall pieces attached together.

Each corner piece being formed from a flat elongated trapezoidal-shape metal piece with an inner face, an outer face, and two longitudinal edges an inlet edge, and an outlet edge. The longitudinal edges are folded toward each other along at least one crease area into a corner shape at least near the outlet edge. The inlet edge is rolled toward its inner face into a curved shape.

Each wall piece is formed from a flat elongated trapezoidal-shape metal piece with an inner face, an outer face, two longitudinal edges a flat inlet edge, and an outlet edge rolled toward its inner face into a curved shape.

The wall pieces and the corner pieces each having a high-wear weld overlay section covering at least a portion of their inner surfaces.

The transition section may be manufactured as a liner to retrofit existing stationary nozzles.

Alternatively, the transition section may be attached to an inlet section to create a unitary stationary nozzle.

The invention may also be embodied as a high-wear solid fuel nozzle having an inlet section and a transition section. The transition section is a conduit having an inlet side connected to the inlet section. The transition section having interleaved corner and wall pieces having tab edges that are welded together along their adjacent tab edges.

Each corner piece has and elongated trapezoidal-shape with an inner face, an outer face, and two longitudinal edges an inlet edge at the inlet side, and an outlet edge. The longitudinal edges are folded toward each other along at least one crease area into a corner shape at least near the outlet edge. The inlet edge is rolled toward the inner face into a curved shape.

Each wall piece has and elongated trapezoidal-shape with an inner face, an outer face, and two longitudinal edges a flat inlet edge, and an outlet edge. The outlet edge is rolled toward the inner face into a curved shape.

Each piece has a high-wear metal overlay section covering their inner surfaces to result in a wear-resistant stationary nozzle that is easy to maintain.

BRIEF DESCRIPTION OF FIGURES

With reference now to the figures where all like parts are numbered alike.

DETAILED DESCRIPTION

Figure 1:
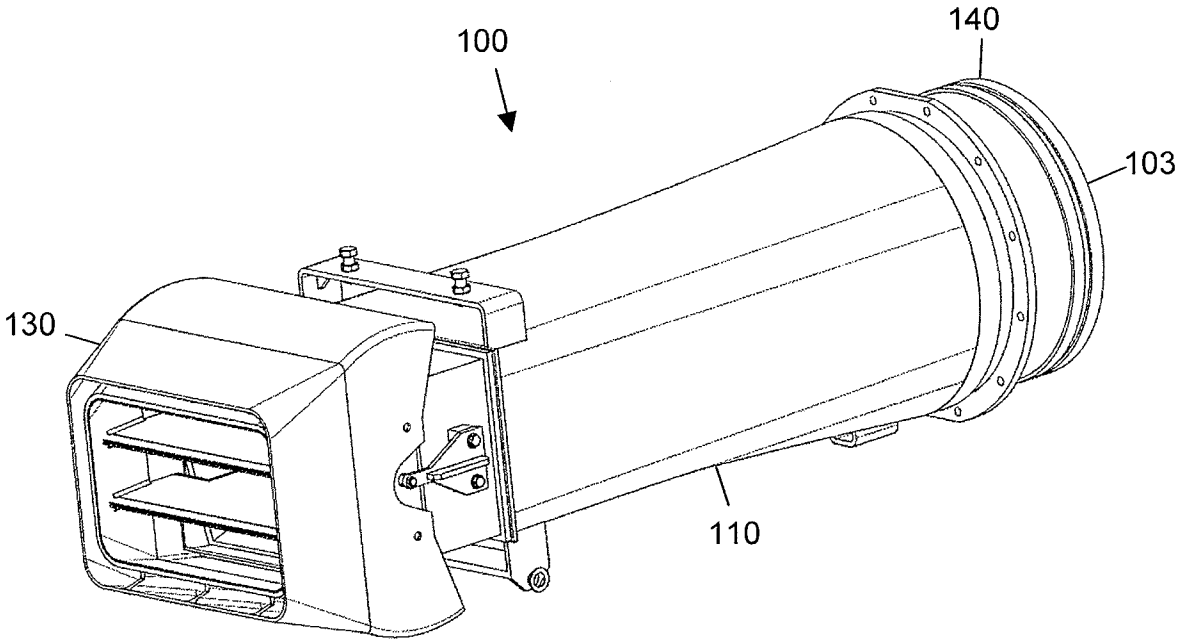
FIG. 1 is a perspective view of a solid fuel nozzle.

Weld overlays are known for creating surfaces of increased wear or abrasion resistance. This is often, but not always linked with the hardness of the material. Weld overlaying is a process of using a welding rod or an elongated welding coil of a welding material that is melted onto the surface of an object to be overlaid. For simplicity, it will be referred to as a welding rod; however, it also applies to welding coils and similar materials. Multiple lines of weld ("bead") are laid down closely adjacent to each other to form one or more layers of welding on the surface of the object. (For a more detailed discussion please see "Chrome Carbide Overlay Plate', Bob Miller of Clad Technologies, Birmingham, Ala., http://cladtechnologies.com/Articles/CrCarbide/article.htm).

The high temperatures used to melt the welding rods are provided by burning gasses or electric arcing. The welding rod material has been heated to a high temperature and quickly cooled on the surface to harden. This process creates a carbide crystalline structure in the metal. The hardness rating and abrasion resistance of the welded material having carbides is much higher than for the material that has not been welded. This overlay material has greater hardness than cast iron or hardened steel, but is not as brittle as ceramic tiles.

The increase in abrasion resistance also results in some loss of ductility. Therefore, base materials coated with weld overlay lose some of their ductility as compared with the material prior to the overlaying process. Sometimes, overlaid materials may not be manufactured by conventional construction processes. If rolled to a small radius of curvature, overlaid materials would fracture during the rolling process. Therefore, the process for constructing nozzles having overlaid materials should be modified for the rolling or folding of the metal. A second overlay process may be used on areas not originally overlaid in the assembly process to maintain a consistent thickness of the overlaid piece.

The overlaid material also is difficult to weld to other pieces. Therefore, the process used must allow for construction taking this into account.

The bead of the weld overlay is applied over the surface of a material to have a physical structure resembling a number of long parallel ridges. Where the ridges meet, there are valleys.

Fluid flow of an air stream with entrained solid particles causes the particles to congregate in the valleys and follow the valleys. This causes increased erosion in the valleys referred to as "channeling". This accelerates wear in the valley areas. The wear increases to cut the channels deeper between weld beads. Therefore, the design of a high-wear nozzle must also take into account the channeling effect.

Weld overlay can only be applied in a direction that prevents dripping. That is, it should be applied on a horizontal surface with gravity assisting the application. Many weld overlay applicators turn the object being welded while holding the weld rod stationary to insure the proper geometry. With the complex round to square transition seen in the present nozzle, the fixtures required and rotation sequence would be complex in order to achieve a high quality product.

The proposed method involves the use of weld overlay using welding rods having a minimum hardness rating of 60 Rockwell. The present invention has the following advantages over the use of cast iron nozzles or ceramic tile inserts: (1) Weld overlay wears less than cast iron, (2) weld overlay material can operate without damage to at least 1000 degrees Fahrenheit (3) weld overlay can be repaired in the field, and (4) weld overlay material is much easier to handle without cracking and breaking than ceramic tiles.

The type and method of application of the weld overlay onto a base material has implications on tensile strength as well as propensity to crack. For National Fire Protection Association (NFPA) compliance, there are minimum burst pressure, tensile strength and other properties that must be maintained in the stationary coal nozzle. (Please refer to the "Pulverized Fuel" section of the "NFPA Boiler and Combustions Systems Hazard Code".)

The nozzle of the present invention must be fabricated in such a way that (a) using a design having pieces that are easy to fabricate, (b) cutting pieces without significant heat concentrations to deteriorate the base metal, (c) overlaying the pieces in a manner which prevents 'channeling', (d) leaving elongated regions at the edges of the pieces without overlay to create seam tabs used to achieve a proper mating surface for welding pieces together, and other areas to facilitate shaping, (e) bending the pieces to a radius that will not cause cracks, (e) welding the seam tabs of the pieces together to create the nozzle structure, and (f) overlaying the welded seam tabs and other non-overlaid regions to result in complete overlay coverage.

Stationary coal nozzles must bear the weight of the final coal elbow and other equipment installed (i.e. burner shut off valves), to an extent, the weight of the coal piping and other equipment installed in the piping system below it. If the proper design and fabrication provisions are not employed, cracks may develop on the entrance flange where the coal pipe connects to the stationary nozzle and other parts of the nozzle.

If there is a concentration of the flow of particles resembling a long rope ('roping') going into the stationary nozzle, a fin should be supplied to straighten out the flow 260.

The present invention is constructed in such a way to conform to the requirements above.

The present invention may be embodied as weld overlay on a base metal to form a liner that fits within a stationary nozzle.

The present invention may also be embodied as a unitary embodiment in which the nozzle has weld overlay covering its the inner surface. The weld overlay and nozzle are integral and there is no liner used.

Designing

Figure 2:
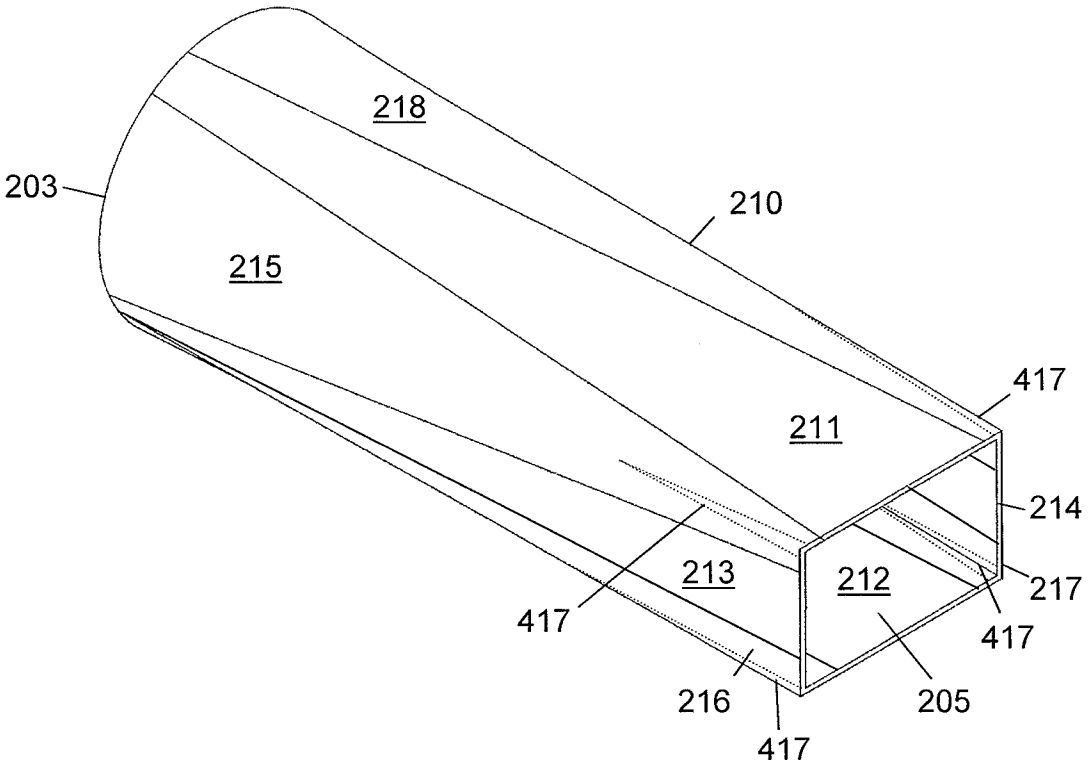
FIG. 2 is a perspective view of a wear-resistant transition section according to the present invention.

FIG. 2 shows a transition section 210 of a nozzle 200 according to the present invention indicating the various parts used to create the transition section 210. In order to meet the criteria for properly constructing the nozzle 200, it must be constructed from multiple pieces.

Figure 3:
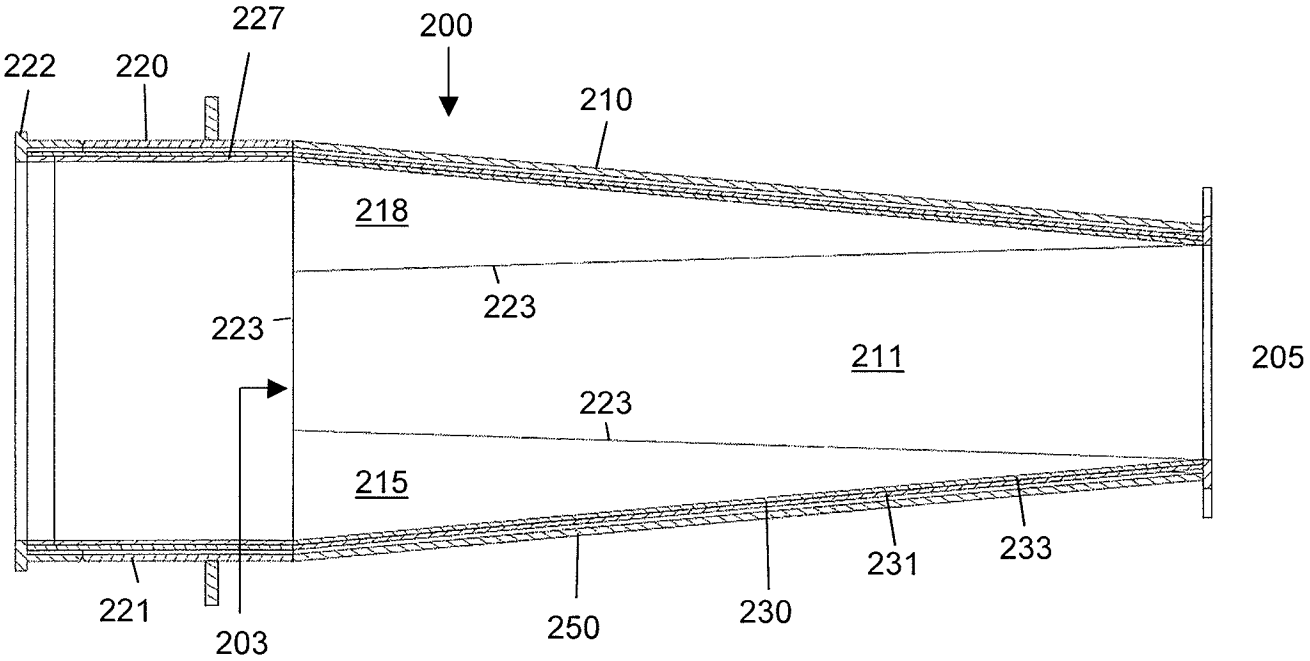
FIG. 3 is a top plan view of the wear-resistant nozzle employing the transition section of FIG. 2.

FIG. 3 is a top plan view of the wear-resistant nozzle of FIG. 2. In this embodiment, an outer shell 250 encloses a liner 230. The liner 230 has a base metal section upon which weld overlay 233 is applied.

It is also to be understood that the weld overlay 233 may be directly applied to the outer shell 250 to create a unitary design with no liner used. Each embodiment has its advantages and both are within the scope of this invention. The remaining description will take into account both embodiments.

Nozzle 200 is constructed from a transition section 210 attached to a cylindrical input piece 220. The cylindrical inlet section 220 has a flange 222 for connecting to coal piping, not shown here.

Referring now to both FIGS. 2 and 3, the transition section 210 is constructed with a horizontal piece 211 for the top of the transition section 210 and a horizontal piece 212 for the bottom. The horizontal pieces 211, 212 in this embodiment have the same shape. Vertical piece 213 has the same shape as vertical piece 214. The horizontal pieces and the vertical pieces may each be referred to as "wall pieces".

In this embodiment, four corner pieces 215, 216, 217, 218 are the same shape and form the corners of the outlet 205.

Since this embodiment has a rectangular outlet 205, horizontal pieces 211, 212 are different from vertical pieces 213, 214. In an alternative embodiment, the vertical pieces and the horizontal pieces would all have the same shape if outlet 205 were square instead of rectangular.

This reduces the number of unique parts to be manufactured and reduces the costs of manufacturing.

Figure 4:
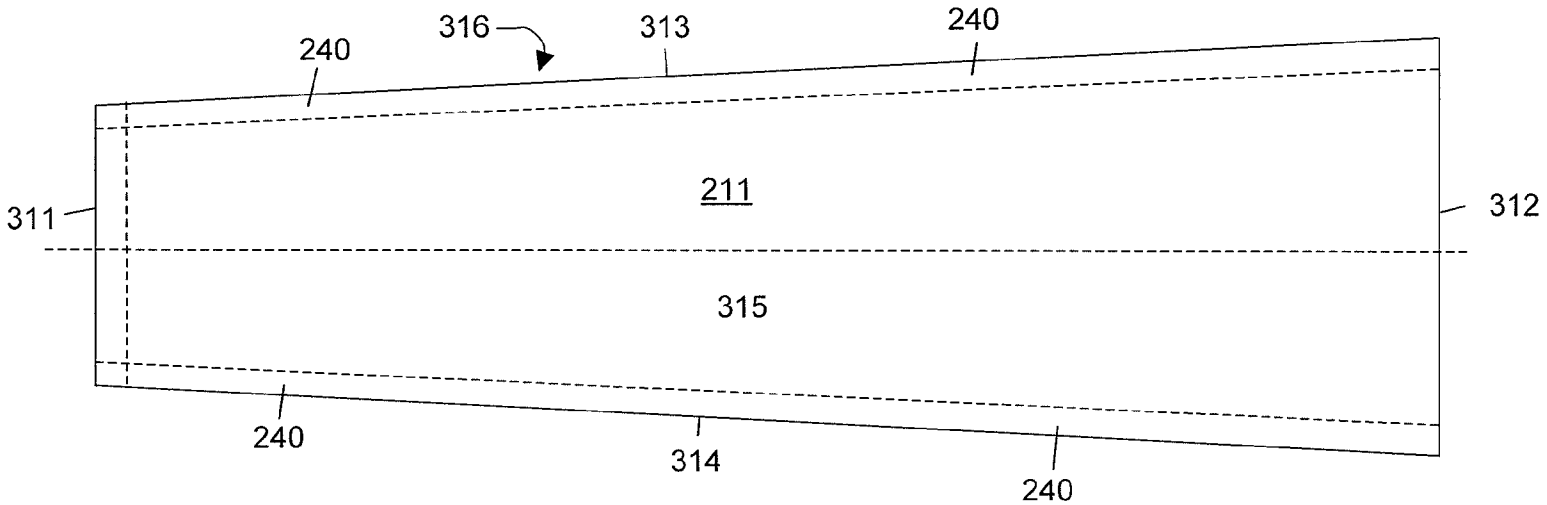
FIG. 4 is a flat pattern used to construct horizontal pieces of the wear-resistant transition section of FIGS. 2 and 3.

FIG. 4 shows the flat pattern used to form horizontal pieces 211, 212. In this embodiment, the vertical pieces 213, 214 have the same shape and proportions as the horizontal pieces 211, 212, but are narrower based upon the ratio of height to width of the rectangular outlet 205. For simplicity, only a horizontal piece 211 will be described here. However, it is understood that the same process also applies for the other pieces 212, 213, 214.

Piece 211 has an inlet edge 311, and outlet edge 312, and two longitudinal edges 313, 314. It also has an outer surface 315 and an inner surface 316. The overlay material will be applied to the inner surface 316 (on the opposite side).

Figure 5:
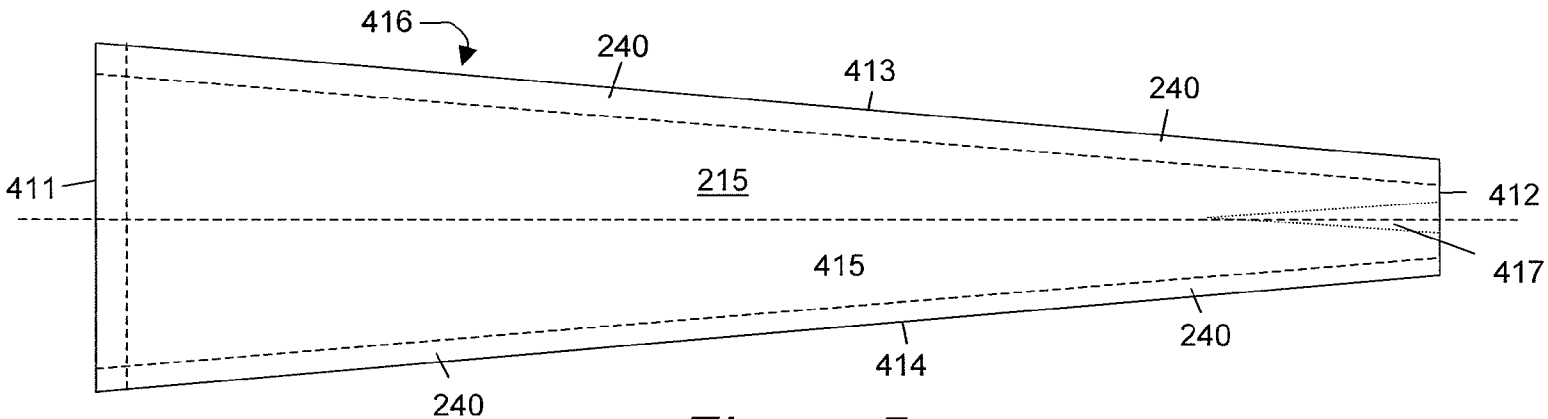
FIG. 5 is a flat pattern used to construct corner pieces of the wear-resistant transition section of FIGS. 2 and 3.

FIG. 5 shows the flat pattern used to form the corner pieces (215, 216, 217, 218 of FIGS. 2 and 3). For simplicity, only a piece 215 will be described here. However, it is understood that the same process also applies for corner pieces 216, 217 and 218.

Corner piece 215 has an inlet edge 411, and outlet edge 412, and two longitudinal edges 413, 414. It also has an outer surface 415 and an inner surface 416 (on the opposite side). The overlay material will be applied to the inner surface 416.

Cutting

The patterns of FIGS. 4 and 5 are optimally cut by EDM methods (as opposed to shearing, plasma cutting, and air arcing). This prevents damage from overheating to the base material, ensuring that the integrity of the base material is not compromised.

Overlaying

The cut pieces are then overlaid with welding material on their inner surfaces, except for areas that will be welded to other structures.

No overlay is applied to the elongated seam tabs 240 approximately 0.5 to 1.5 inches wide running the length of the edges. A seam tab 240 is an elongated area near the edge of each piece where they are welded together. The pieces, after being shaped, are later arranged such that the seam tabs 240 overlap. These are then welded together along their length.

In order to create a longer-lasting nozzle, the weld overlay bead of the present invention is applied in a direction perpendicular to the predominant coal air mixture flow axis. This will be in a direction perpendicular to an axis passing through the nozzle length. This prevents particle flow from becomes concentrated in the lower valley areas between adjacent weld lines preventing 'channeling'.

Figure 6:
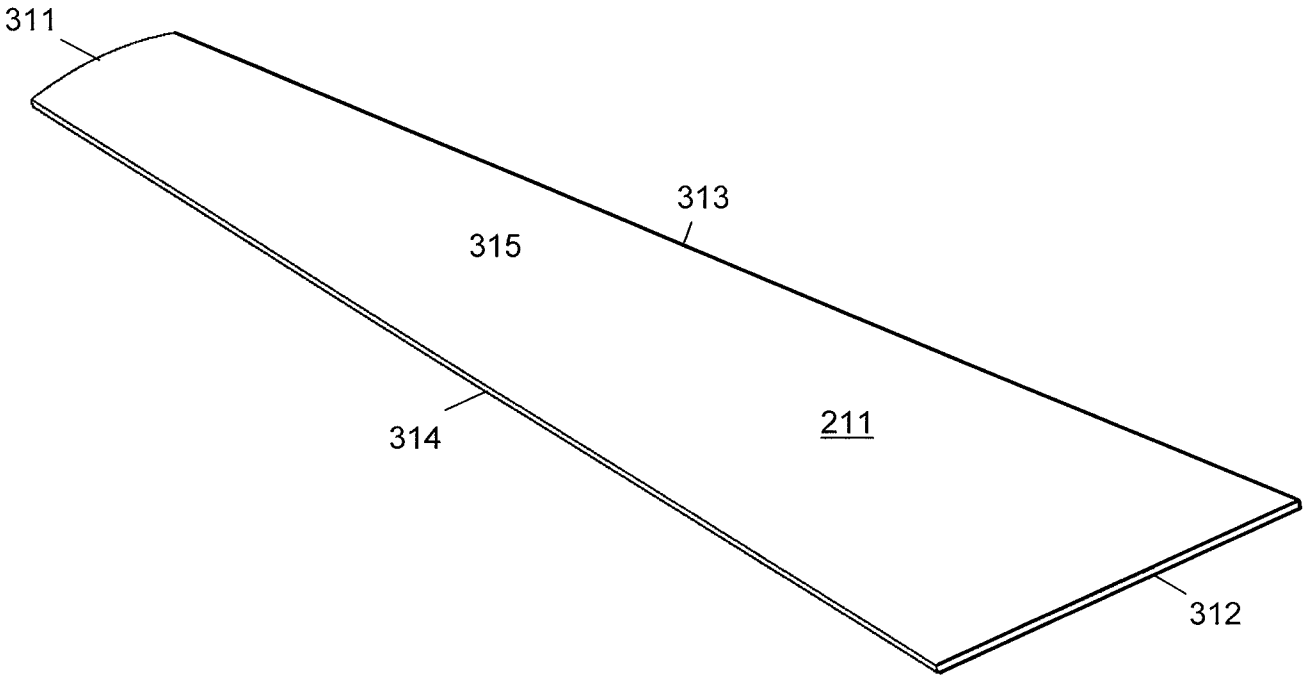
FIG. 6 is a perspective view of a horizontal piece of a transition section according to the present invention constructed from the flat piece of FIG. 4.

The base materials, even after fabrication operations, must meet the NFPA burst and tensile strength requirements. Therefore, chromium carbide with either a 60 or 70 Rockwell hardness was the preferred material used for the welding rods of the weld overlay. It is understood that other overlay materials could be used, Shaping The flat horizontal piece 211 of FIG. 4 is shaped to form horizontal piece 211 of FIG. 6. The outlet edge 312 of the horizontal pieces 211 of FIG. 4 is kept flat to form part of the outlet (205 of FIG. 2). The inlet edge 311 is rolled to form a curved surface with the inner surface 316 on the inside of the curve. The inlet edge 311 forms part of the inlet (203 of FIG. 2).

Referring to FIG. 2, the other horizontal piece 212 and the vertical pieces 213, 214 are shaped in a manner similar to that of horizontal piece 211.

In a preferred embodiment as shown in FIG. 5, no overlay material is initially applied to a crease area 417 on the inner surface 416 near an outlet edge 412 of the corner piece 215.

Figure 7:
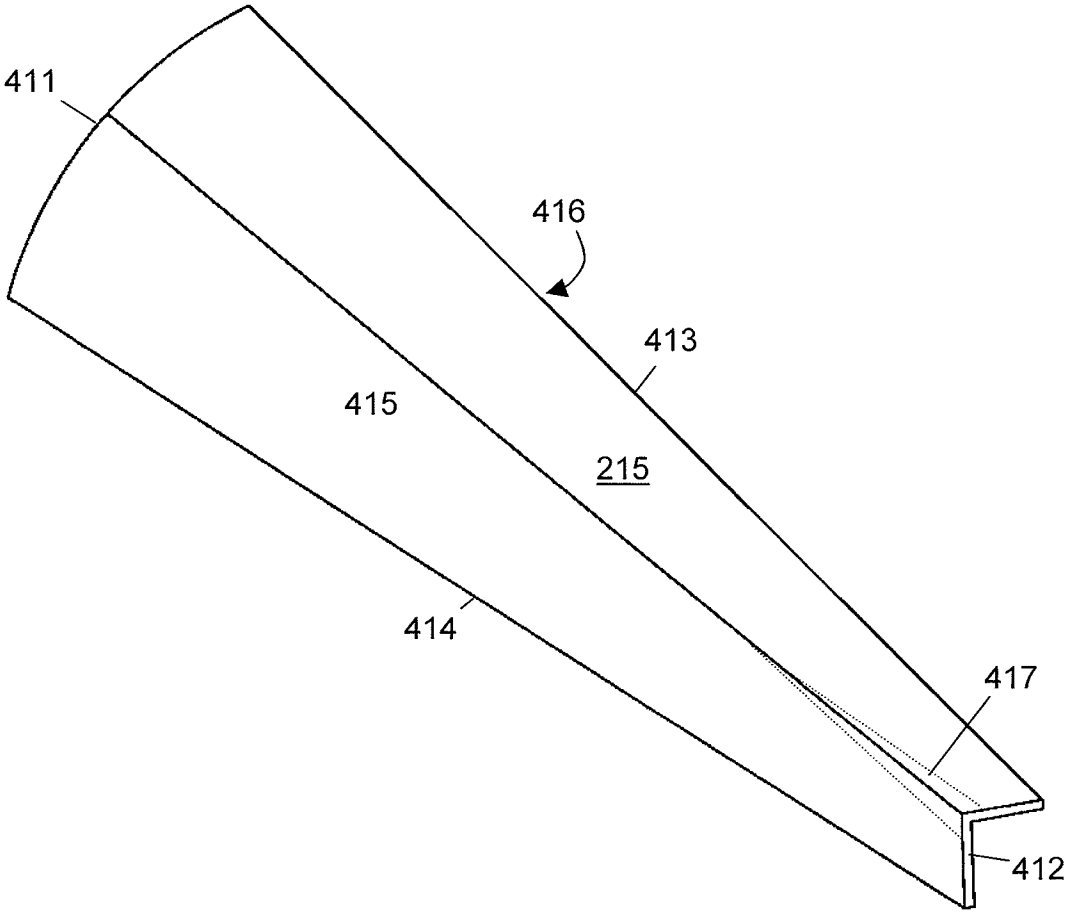
FIG. 7 is a perspective view of the corner piece of a transition section according to the present invention constructed from the flat piece of FIG. 5.

Flat corner piece 215 of FIG. 5 is shaped to form the corner piece 215 of FIG. 7. Corner piece 215 has a larger inlet edge 411 and a smaller outlet edge 412.

The inlet edge 411 is rolled into a curved shape with an inner surface 416 inside of the curve. The outlet edge 412 is folded into a corner. Since this corner has a small radius of curvature, preferably, weld overlay is not initially provided on the crease region 417. These crease regions are then overlaid after the folding process. Except for these corners, all other curvature required in the shaping process is gradual enough not to cause cracking of the overlaid material.

The overlaid pieces are designed to be bent with or without heat. However, it is preferred that the overlaid pieces be bent and otherwise formed after heating to prevent stress accumulations.

Assembling

As shown in FIGS. 4 and 5, seam tabs 240 of the two adjacent parts, such as horizontal piece 211 and corner piece 215 are positioned adjacent each other such that seam tab 240 of longitudinal edge 314 of horizontal piece 211 overlaps seam tab 240 of longitudinal edge 413 of corner piece 215.

These seam tabs 240 are welded with full penetration welds for strength, along their lengths. A full penetration weld passes through the entire thickness of both pieces being welded creating seams 223 between the parts. These full penetration welds also make a strong, continuous seal between the parts. This creates a sealed seam 223 preventing pulverized solid fuels entrained in an air stream to leak out of this seam. This process continues for all of the pieces to create the nozzle conduit as shown in FIGS. 2 and 3.

After the parts have been welded together, a layer of weld overlay protection is then applied to the inside surface of the seam tabs 240 to protect them.

Adding Inlet Section

Figure 8:
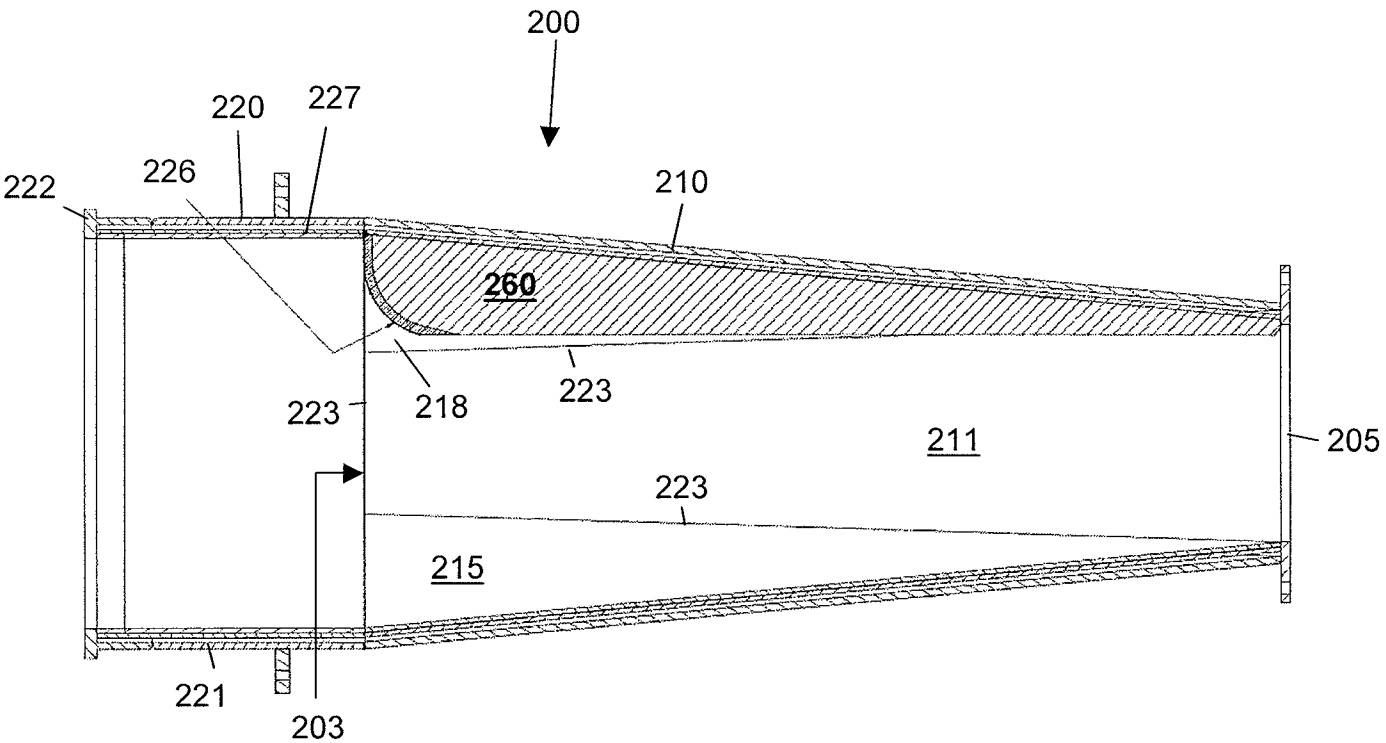
FIG. 8 is a plan view of another embodiment of a wear-resistant nozzle according to the present invention.

Referring now to FIG. 8, the nozzle 200 typically supports the weight of the attached coal pipes (not shown), as well as other equipment in the piping system (not shown) attached to flange 222. The weight typically introduces cracking near a seam where a flange is welded to the transition section and/or other parts of the nozzle. The design must also have significant strength at its attachment point, flange 222, to be able to support the fuel pipes and part of the nozzle 200.

The present invention uses inlet piece 220 that does not have a welded flange, but is machined from a single piece of metal. The flange 222 is part of the cylindrical body 221 and was fabricated as part of a single piece. Therefore, there are no weld lines for flange 222 and therefore no weak seam.

In the unitary embodiment, the cylindrical body 221 is then welded to the transition section 210. An inlet liner 227 is inserted into the cylindrical body that fits flush against the overlay 231 of transition section 210.

This is a stronger embodiment than the more traditional bevel weld on a ring. This eliminates the weaker bevel welds and uses only full penetration weld between the inlet piece 220 and the transition section 210 for maximum strength.

In the liner embodiment, the liner 230 is inserted into the outer shell 250 of the transition section 210. The cylindrical body 221 is then welded to the outer shell 250 of the transition section 210. The inlet liner 227 is then inserted into the cylindrical inlet section 220. The liners 230, 227 act as wear-resistant boundary protecting the nozzle 200.

The unitary fabrication embodiment has size, weight and cost advantages over the liner embodiment, but must be constructed to pass the NFPA requirements without the support of a liner. (Please refer to the "Pulverized Fuel" section of the "NFPA Boiler and Combustions Systems Hazard Code".)

FIG. 8 is a plan view of an alternative embodiment of the nozzle 200. In this embodiment, a partial cutaway view reveals an optional coal rope-breaking fin 260 to break up coal 'roping'. Roping occurs when the particles concentrate in long streams resembling ropes. The rope breaking fin 260 can wear back slowly (since the fin is very long in that dimension) without jeopardizing the function of the fin. To further reduce wear, the edge of the rope-breaking fin 260 has a curved shape. A protector bar 226 of softer material more ductile to receive better direct impingement resistance is at the leading edge to reduce wear.

In the embodiments described above, eight individual piece parts are used for transition section 210 of either the liner 230 or the unitary transition section 210; however, alternative embodiments may be used having more or fewer pieces.

The following example, which is meant to be exemplary, not limiting, illustrates the method of creating a wear-resistant nozzle.

Figure 9:
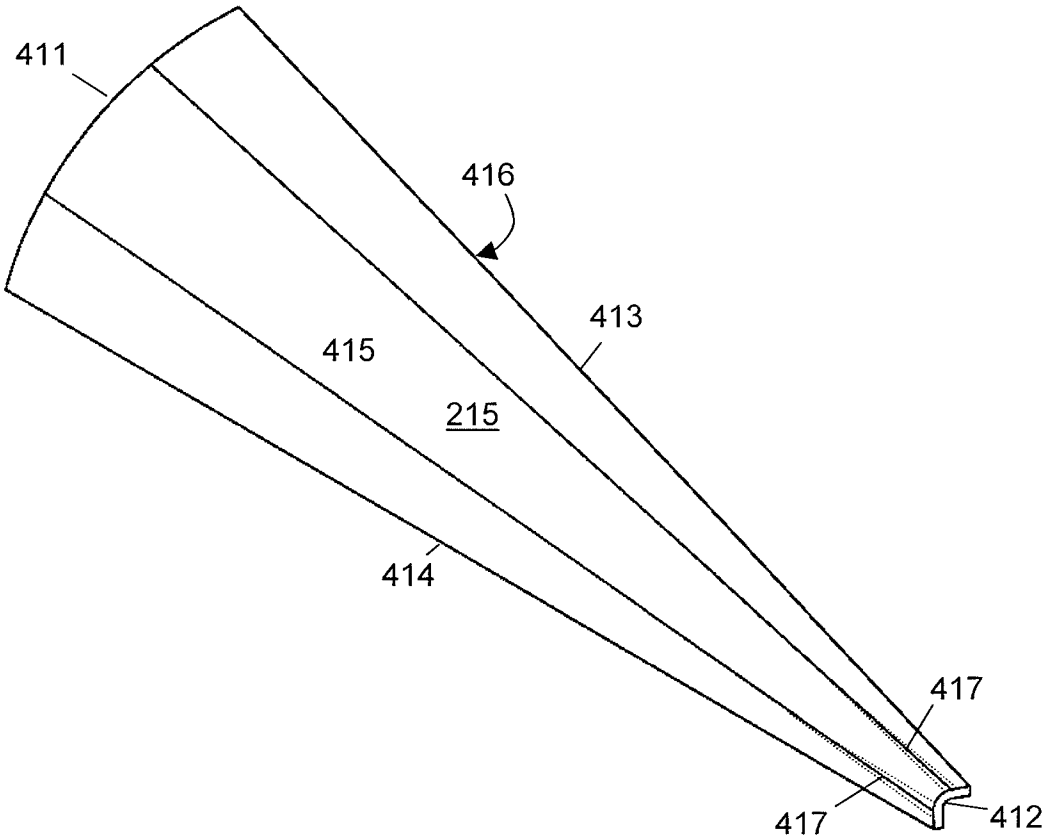
FIG. 9 is a perspective view of another embodiment of a corner piece for a transition section according to the present invention.

In still a further embodiment as shown in FIG. 9, corner piece 215 may have two or more crease areas 417 facilitate bending. Each additional crease area reduces the amount of bending required since the bending angle at each crease is added to result in the total bending. Preferably, these crease areas 417 should have little or no weld overlay on their inner surfaces 416 to further facilitate bending.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

What is claimed is:

1. A high-wear solid fuel nozzle transition section comprised of:

a plurality of interleaved corner pieces and wall pieces each having tab edges welded to tab edges of adjacent wall pieces and corner pieces, respectively, to form a conduit having an inlet end and an outlet end;

each corner piece formed from a flat corner elongated trapezoidal-shape metal piece with a corner inner face, a corner outer face, two corner longitudinal edges, a corner inlet edge, and a corner outlet edge with the two corner longitudinal edges folded toward each other along at least one corner crease area into a corner shape at least near the corner outlet edge, and the corner inlet edge rolled toward the corner inner face into a curved shape, each wall piece formed from a flat wall elongated trapezoidal-shape metal piece with a wall inner face, a wall outer face, two wall longitudinal edges, a flat wall inlet edge, and a wall outlet edge rolled toward the wall inner face into a curved shape, the wall pieces and the corner pieces each having a high-wear weld overlay section covering at least a portion of the wall inner face and the corner inner face, respectively.

2. The high-wear solid fuel nozzle transition section of claim 1, wherein the transition section is adapted to act as a liner to retrofit existing stationary nozzles.

3. The high-wear solid fuel nozzle transition section of claim 1, wherein the transition section is adapted to be attached to a cylindrical inlet section to create a stationary nozzle.

4. The high-wear solid fuel nozzle transition section of claim 1, wherein the weld overlay is comprised of:

a plurality of parallel weld beads running in a direction substantially perpendicular to an axis running through a length of the transition section.

5. The high-wear solid fuel nozzle transition section of claim 1, wherein the each corner and wall longitudinal edge has an elongated tab region not covered with the weld overlay section to facilitate welding of the elongated tab region of one corner or wall piece to an adjacent corner or wall piece to create a seam.

6. The high-wear solid fuel nozzle transition section of claim 1, wherein welding of each of the elongated tab regions of one corner or wall piece to an adjacent corner or wall piece creates seams and the seams are weld overlaid.

7. The high-wear solid fuel nozzle transition section of claim 1, wherein chromium carbide is used as a weld overlay material.

8. The high-wear solid fuel nozzle transition section of claim 1, wherein at least two of the corner pieces have the same dimensions to simplify construction and to reduce manufacturing costs.

9. The high-wear solid fuel nozzle transition section of claim 2, wherein liner may be repaired to reduce maintenance costs.

10. The high-wear solid fuel nozzle transition section of claim 1, wherein the corner inner face at the corner crease area of the flat corner elongated trapezoidal-shape metal piece used to form the corner piece is not weld overlaid.

11. The high-wear solid fuel nozzle transition section of claim 1, wherein each flat corner elongated trapezoidal-shape metal piece used to form a corner piece is bent on a plurality of corner crease areas.

12. A high-wear solid fuel nozzle comprised of:

a. a cylindrical inlet section;

b. a transition section being a conduit having an inlet side connected to the cylindrical inlet section, comprised of:

a plurality of interleaved corner pieces and wall pieces each having tab edges welded together along adjacent wall piece and corner piece tab edges, respectively;

each corner piece having an elongated trapezoidal-shape corner piece with a corner inner face, a corner outer face, two corner longitudinal edges, a corner inlet edge at the inlet side, and a corner outlet edge, the two corner longitudinal edges folded toward each other along at least one corner crease area into a corner shape at least near the corner outlet edge, and the corner inlet edge rolled toward the corner inner face into a curved corner shape, each wall piece having an elongated trapezoidal-shape wall piece with a wall inner face, a wall outer face, two wall longitudinal edges, a flat wall inlet edge, and a wall outlet edge rolled toward the wall inner face into a curved wall shape, each corner piece and wall piece having a high-wear metal overlay section covering the corner inner faces and wall inner faces, respectively.

13. The high-wear solid fuel nozzle of claim 12, wherein the metal overlay is comprised of:

a plurality of parallel weld beads running in a direction substantially perpendicular to an axis running through a length of the transition section.

14. The high-wear solid fuel nozzle of claim 12 wherein the each corner longitudinal edge and wall longitudinal edge has a corner elongated tab region or wall elongated tab region, respectively, not covered with weld overlay to facilitate welding of the corner or wall elongated tab region of one corner or wall piece to an adjacent corner or wall piece to create a seam.

15. The high-wear solid fuel nozzle of claim 12 wherein the seams are weld overlaid.

16. The high-wear solid fuel nozzle of claim 12 wherein chromium carbide is used as a weld overlay material.

17. The high-wear solid fuel nozzle of claim 12 wherein the cylindrical inlet section has an inlet section inner face that has weld overlay.

18. The high-wear solid fuel nozzle of claim 12 wherein at least two of the corner pieces have the same dimensions to simplify construction and to reduce manufacturing costs.

19. The high-wear solid fuel nozzle of claim 12 wherein both the wall pieces and the corner pieces may be constructed form a single flat shape to simplify construction and to reduce manufacturing costs.

* * * * *